US006755480B2

(12) United States Patent
Sult et al.

(10) Patent No.: US 6,755,480 B2
(45) **Date of Patent: *Jun. 29, 2004**

(54) DRUM-TYPE DUAL CHANNEL WATER-JET ASSISTED CUTTING HEAD

(75) Inventors: Donald B. Sult, Charlottesville, VA (US); Jeffrey J. Schwoebel, Free Union, VA (US)

(73) Assignee: Amvest Corporation, Charlottsville, VA (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/090,104

(22) Filed: Feb. 27, 2002

(65) Prior Publication Data

US 2002/0158503 A1 Oct. 31, 2002

Related U.S. Application Data

(63) Continuation-in-part of application No. 09/540,044, filed on Mar. 31, 2000, now Pat. No. 6,409,276.

(51) Int. Cl.[7] ..... E21C 25/60
(52) U.S. Cl. ..... 299/17; 299/81.1; 299/81.2
(58) Field of Search ..... 299/17, 81.1, 81.2, 299/81.3

(56) References Cited

U.S. PATENT DOCUMENTS

| | | | | |
|---|---|---|---|---|
| 2,650,813 A | | 9/1953 | Rollins et al. | 262/33 |
| 3,614,162 A | | 10/1971 | Teeter | 299/67 |
| 3,730,593 A | | 5/1973 | Karlovsky, Jr. | 299/76 |
| 3,799,615 A | | 3/1974 | Taylor et al. | 299/59 |
| 3,804,466 A | | 4/1974 | Cilles | 299/78 |
| 4,049,318 A | | 9/1977 | Fruin | 299/81 |
| 4,212,497 A | | 7/1980 | Borowski et al. | 299/53 |
| 4,314,730 A | | 2/1982 | Plumpton et al. | 299/75 |
| 4,375,904 A | * | 3/1983 | Beckmann et al. | 299/53 |
| 4,437,708 A | * | 3/1984 | Stoltefuss | 299/81.1 |
| 4,451,089 A | | 5/1984 | Paurat et al. | 299/43 |
| 4,648,660 A | | 3/1987 | Mann et al. | 299/10 |
| 4,836,613 A | | 6/1989 | Adam | 299/81 |
| 4,846,631 A | | 7/1989 | Parrott | 417/273 |
| 5,114,213 A | | 5/1992 | Kornecki et al. | 299/81 |
| 5,507,565 A | | 4/1996 | LeBegue et al. | 299/12 |
| 5,690,392 A | | 11/1997 | Clapham | 299/81.1 |

FOREIGN PATENT DOCUMENTS

| | | |
|---|---|---|
| DE | 30 49 216 A1 | 7/1982 |
| DE | 31 48 826 A1 | 6/1983 |
| DE | 35 21 560 A1 | 5/1986 |
| GB | 2 125 850 A | 3/1984 |

OTHER PUBLICATIONS

Partial International Search Report dated Jul. 20, 2000 for PCT/US00/08572.

Database WPI, Section PQ, Week 199922, Derwent Publications Ltd., London, GB; AN 1999–264201 XP002153117 & ZA 9 806 639 A (Kennametal Inc.) Apr. 28, 1999 abstract.

Complete International Search Report dated Nov. 28, 2000 for PCT/US00/08572.

* cited by examiner

*Primary Examiner*—John Kreck
(74) *Attorney, Agent, or Firm*—Jenkens & Gilchrist, P.C.

(57) ABSTRACT

A drum-type miner having a plurality of water jet nozzles which cut independently of the mechanical bits is disclosed. The drum-type miner may configured in either a hard-head or a ripper-chain design. The unique combination of mechanical and hydraulic cutting results in higher rates of penetration and improved productivity. The nozzles in one embodiment are supplied on a transversely mounted strut and are supplied with high-pressure fluid through two independent water channels in the strut. The nozzles may be configured in different directions, such that the high-pressure fluid may be directed in several directions simultaneously, or configured to direct the high-pressure fluid in one direction only. Moreover, because the mining face is pre-scored by the water jets, the amount of wear on both the mechanical bits and the motors may be significantly reduced.

17 Claims, 11 Drawing Sheets

DRUM-TYPE DUAL CHANNEL WATER-JET ASSISTED CUTTING HEAD

RELATED APPLICATION (S)

This application is a Continuation-In-Part of prior application Ser. No. 09/540,044 filed on Mar. 31, 2000, now U.S. Pat. No. 6,409,276.

FIELD OF THE INVENTION

The present invention generally pertains to mineral mining processes and, more particularly, but not by way of limitation, to a mining system particularly adapted for the recovery of coal from coal seams.

History of the Related Art

The recovery of coal, ore, or other material from mineral bearing strata or seams has been the subject of technological development for centuries. Among the more conventional mining techniques, drum-type mining systems have found industry acceptance. Drum-type mining machines typically utilize a cutting head having a rotating cylinder or drum with a plurality of mechanical bits on an exterior surface for cutting into the mineral bearing material. The dislodged material is permitted to fall to the floor of the mining area, gathered up, and transported to the mining surface via conveyors or other transportation means.

Although drum-type mining machines have proven effective, conventional drum-type cutting systems generally rely solely on a mechanical cutting action which subjects motors and bits to considerable wear and produces significant amounts of dust. Also, to increase the productivity of conventional mechanical cutting machines will normally require the installation of larger and heavier cutting motors on the miner to produce the additional power needed.

Thus, there is a need for a reliable mining system which addresses the limitations of the above-described conventional mining systems and which achieves higher rates of penetration and improved productivity.

SUMMARY OF THE INVENTION

The present invention overcomes the foregoing and other problems with a dual-channel water jet assisted, drum-type mining system which positions a plurality of high pressure water jets receiving water from a first channel to cut the mining face in two directions independently of mechanical bits, and positions a plurality of high pressure water jets receiving water from a second channel to allow sumping in another direction during downward shear. This combination of mechanical and hydraulic cutting results in higher rates of penetration and improved productivity. The high pressure water used in cutting may be pumped via a hose line or other conduit from a remote location. Alternatively, a high pressure water pump may be located on the chassis of the miner. Of course, this means that the cutting motors on the drum-type miner itself can be much smaller than the motors used to generate equivalent production by conventional means. Moreover, because the mining face is pre-scored by the water jets, the amount of wear on both the mechanical bits and the motors may be significantly reduced.

BRIEF DESCRIPTION OF THE DRAWINGS

For a more complete understanding of the present invention, and for further objects and advantages thereof, reference is made to the following Detailed Description taken in conjunction with the accompanying drawings in which.

DETAILED DESCRIPTION

It has been discovered that the use of water-jet assistance during mining operations assist in the liberation of the coal from the working face of the mineral seam. The high-pressure streams of water actually penetrate and cut into the coal surface independent of and beyond the reach of the mechanical bits used during the drilling operation. These slots or grooves in the mineral face, cut by the high-pressure water jets, reduce the amount of energy required for mechanical excavation by pre-fracturing the coal and providing additional free faces for the coal to break as it is impacted by the mechanical bits. It has also been discovered that the use of multi-directional water-jets can aid in the pre-fracturing of the coal and mineral deposits. Such systems will be described in more detail below.

High-pressure water jets as described below, in conjunction with the water provided to the working area also have the significant benefit of greatly reducing the amount of coal dust liberated during the mining process. The amount and pressure of water provided to each of the water nozzles 185 may further be varied independently, depending on the specific application.

The preferred embodiment of the present invention and its advantages are best understood by referring to FIGS. 1–11*b* of the drawings, like numerals being used for like and corresponding parts in each of the various drawings.

Figure 1:
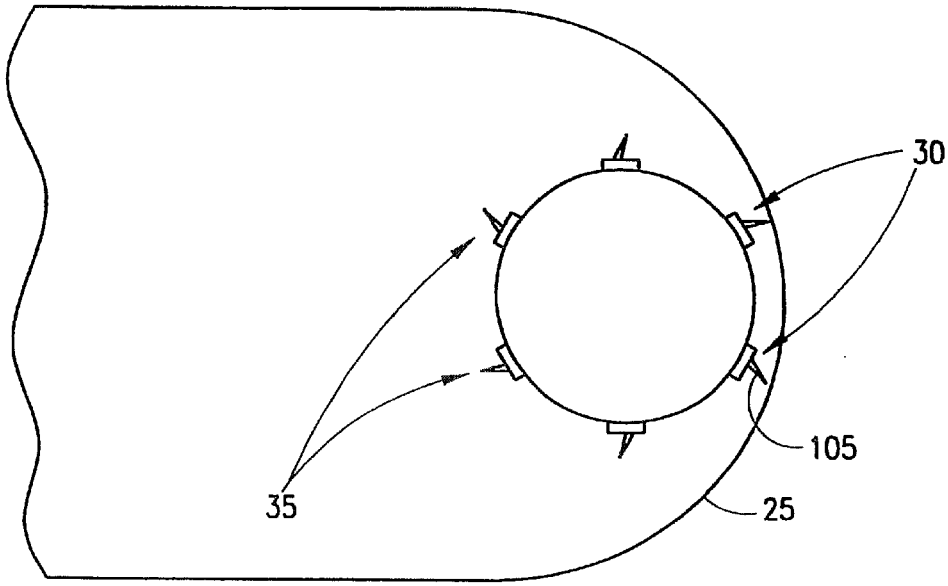
FIG. 1 PRIOR ART
FIG. 1 is a side elevational view of a drum-type cutting head contacting a mineral seam.

The mechanical cutting capabilities of drum-type continuous miners, used for mining coal and other minerals, can be supplemented by the inclusion of high-pressure water jets. Unlike borer-type miners where mechanical bits continuously contact the cutting face, the mechanical bits on a drum miner cut coal or contact the excavation point less than 50% of the circumference of the drum. As best seen in FIG. 1, less than half of the mechanical bits 105 on the drum-type cutting head 110 typically contact the cutting surface 25 at one time. For example, the bits denoted by reference number 30 are in contact with and cutting the mining face 25 while the other bits 35 will not contact the mineral seam until the drum is rotated almost 180°. This also complicates the addition of water jets to the rotating drum 110 itself, and substantially reduces their effectiveness because, if mounted this way, at least half of the nozzles would be directed away from the mining face 25 at any one time.

Figure 2:
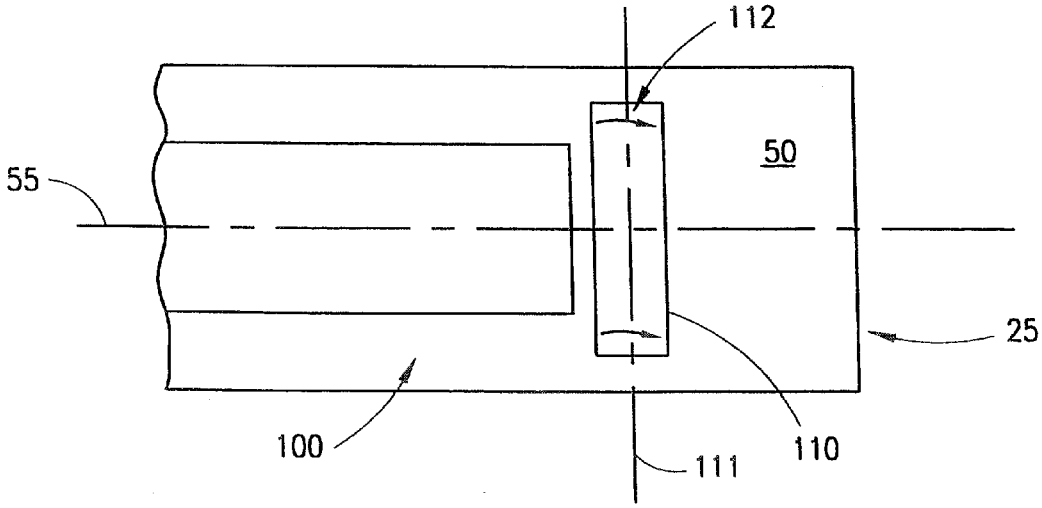
FIG. 2 PRIOR ART
FIG. 2 is a simplified, top plan view of a drum-type mining system.

As best seen in FIG. 2, a simplified drum-type continuous miner 100 has a horizontal cylinder or drum 110 with its axis of rotation 111 perpendicular to the center line 55 of the opening or entry being developed 50. As the miner 100 is advanced toward the mining face 25, the drum is turned in a top-forward direction of rotation 112 to achieve a cutting action with the mechanical bits, not shown. Also, the drum 110 is generally moved up and down in a vertical plane, not shown, to increase the height of the opening 50 and overall production.

Figure 3A:
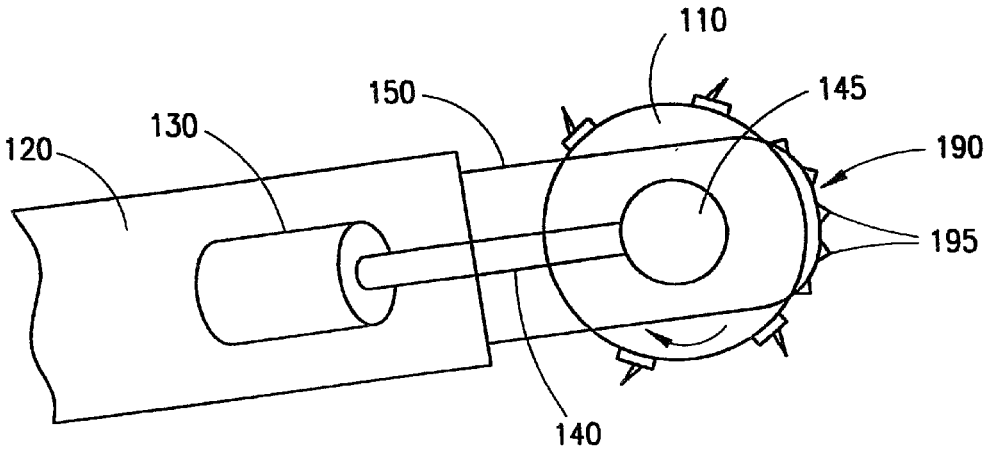
FIG. 3a PRIOR ART
FIG. 3*a* is a cutaway, side elevational view of a hard-head cutting head for drum-type mining systems.
Figure 3B:
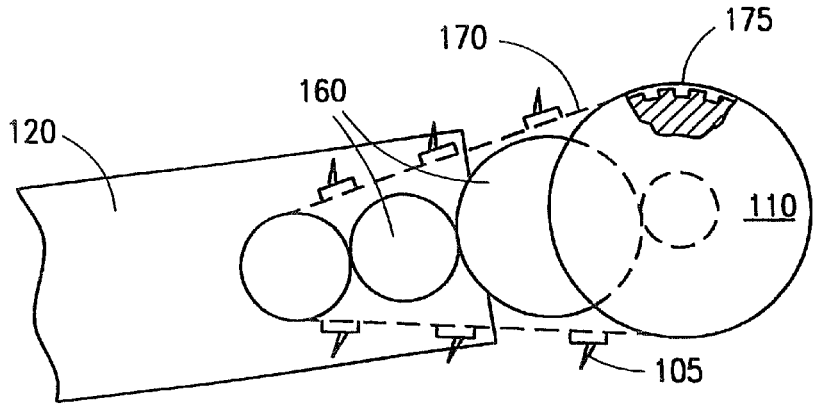
FIG. 3b PRIOR ART
FIG. 3*b* is a cutaway, side elevational view of a ripper-chain cutting head for drum-type mining systems.

With reference now to FIGS. 3*a* and 3*b* together, the cylinder 110 is rotatably mounted to an arm or a boom 120. The electric motors 130 to rotate the drum 110 may be mounted in the body of the miner, not shown, or the boom 120, with the energy being transferred from the motors 130 to the drum 110 using either: (1) rotating drive shafts 140 housed within fixed supports 150, as shown in FIG. 3A, or (2) gears 160 located behind and beneath a cutter or ripper chain 170, seen in FIG. 3B, which wraps around the drum 110, a central portion of which has gear-like teeth 175 for engaging the underside of the chain 170, and an idler located on the support boom 120. Either of these methods uses the rotating mechanical energy of an electric motor 130 to cause the drum 110 to rotate, top forward at a speed of approximately 60 revolutions per minute.

Figure 4:
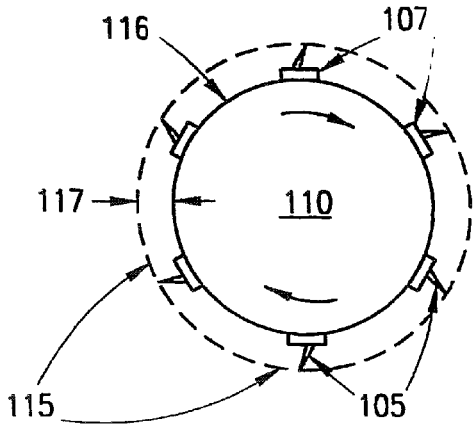
FIG. 4 PRIOR ART
FIG. 4 is a side elevational view of a cutting drum with mechanical bits mounted on an exterior surface and showing an effective cutting diameter.

As best seen in FIG. 4, the effective cutting diameter 115 as defined by the cutting bits 105 is greater than the diameter 116 of the smooth exterior surface of the drum 110. This provides an off-set or distance 117 within which water jet nozzles and high pressure conduits may be mounted as in FIGS. 6A and 6B. The distance 117 may be calculated by subtracting the drum radius from the effective cutting radius. This distance 117 will typically range from about 3 to about 8 inches, but it is understood that this distance 117 is dependent only on the size of the drum 110 and the length of the bits 105 and bit blocks 107 selected and is not limited only to this particular range.

Figure 5:
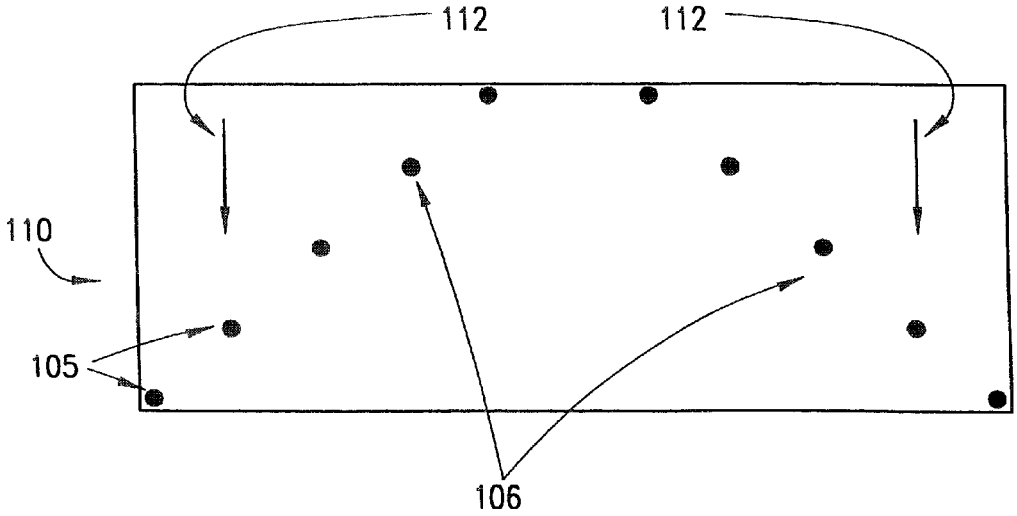
FIG. 5 PRIOR ART
FIG. 5 is a front elevational view of a cutting drum showing a typical scrolling pattern to the bits.

As illustrated in FIG. 5, mechanical bits 105 are typically attached to the smooth exterior surface of the drum 110 in positions that create various patterns as it rotates. This is referred to as the scroll 106 of the bits 105. The spacing of the track, made by the mechanical bits 105 on the cutting surface 25, varies, depending on the longitudinal spacing of the mechanical bits 105. Typically, the track spacing or bit lace spacing will be from about 1.5 to about 3 inches, or more. These mechanical bits 105 are removable. They are inserted in bit lugs or bit blocks 107, which are in turn welded solidly to the exterior surface of the drum 110. The mechanical bits 105 can be routinely removed from this bit lug 107 and replaced as they wear.

The plumbing necessary to provide high-pressure water at sufficient flows to water jets can take advantage of the bit spacing or lacing, and the distance 117 between the smooth exterior surface of the drum 110 and the actual cutting diameter of the bits 105. Water jets can be preferably mounted in two different ways.

Figure 6A:
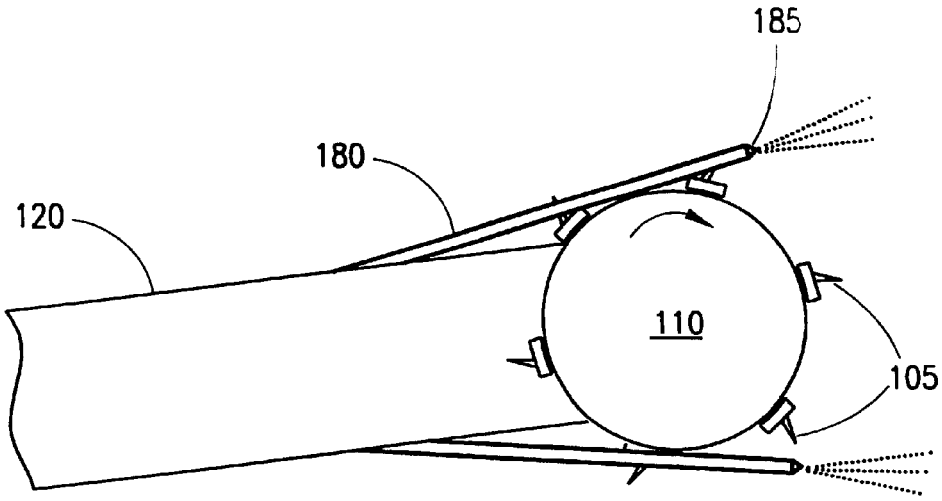
FIG. 6*a* is a side elevational view of a water jet assisted cutting head of the present invention showing a high pressure fluid conduit mounted tangentially above and below the drum.

As shown in FIG. 6A, a first embodiment would involve the addition of a high pressure water hose, not shown, and metal piping 180, which is run from the miner body or the boom 120 and mounted tangent to the upper and lower surfaces of the drum 110. This piping 180, positioned within the effective cutting diameter 115 of the cutting head 110, can actually extend beyond the center line of the cylinder 110, so that the water jet nozzles 185, are only slightly back from the mechanical bits 105 in contact with the mineral seam, not shown.

Figure 6B:
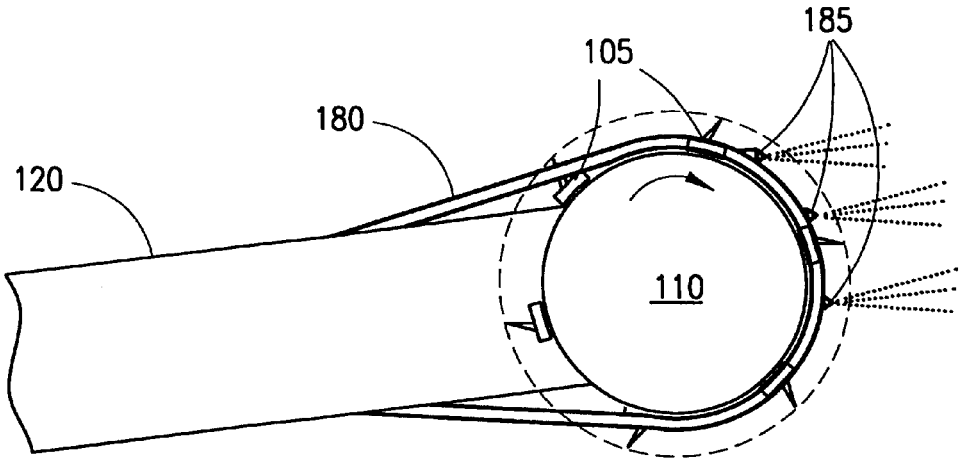
FIG. 6*b* is a side elevational view of a water jet assisted cutting head of the present invention showing a high pressure fluid conduit shaped to fit between the exterior surface of the drum and the effective cutting diameter as defined by the mechanical bits.

As illustrated in FIG. 6B, a second embodiment would involve the addition of a high pressure water hose, not shown, and metal piping 180, which is run from the miner body or the boom 120 and may be curved or shaped to fit about the circumference of and just beyond the smooth exterior surface of the drum 110. The piping or conduits 180 are positioned within the effective cutting diameter 115 of the cutting head 110, and can be tapped and fitted with nozzles 185 which are located between the surface of the drum 110 and the cutting face 25 of the material being mined. Thus, the distance between the coal face 25 and the nozzles 185 is effectively minimized.

Either of these two exemplary embodiments would provide rigidly mounted high-pressure conduits 180 having water jet nozzles 185 at a very close distance to the solid coal being cut. The jet nozzles 185 provide high-pressure water which assists mining by cutting and creating a vertical slot or groove in the coal face from roof to floor as the drum 110 is moved up and down in a conventional cutting motion. These vertical grooves effectively pre-score the coal face and make it far easier for the mechanical bits 105 to then fracture the coal.

Figure 7:
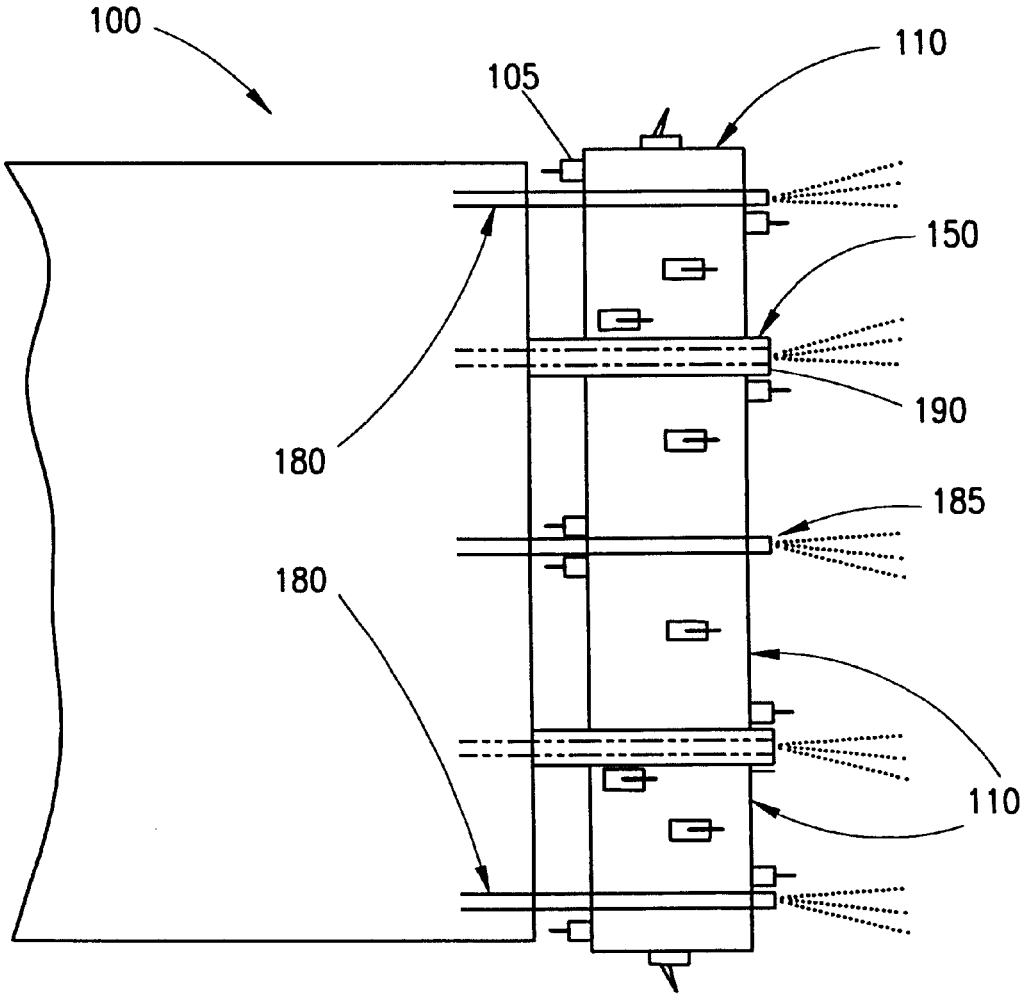
FIG. 7 is a top plan view of a hard-head embodiment of the water jet assisted cutting head of the present invention.

As shown in FIG. 7, an alternative method of mounting water jets 185 would involve running high-pressure water lines 180 at least partially within the existing support struts 150 of a hard-head miner, introduced in FIG. 3A. Various techniques are used to rotate the drum 110. The support struts 150 are rigid, non-rotating members that may or may not contain drive shafts for rotating the cylinder 110. The plumbing 180 can provide high-pressure water and sufficient flow to several water jets 185 mounted on the front, or core breaker edge 190 of these support struts 150. These support struts 150 are non-rotating, while the actual segmented cylinder, or drum 110, rotates on either side of the support strut 150. Since these support struts 150 must be sufficiently wide to contain mechanical parts like a drive shaft, there is usually a zone of solid, uncut coal, referred to as a core, which forms between the two rotating drums 110. The front edge 190 of the support strut 150 typically contains bits or sharp points 195, see FIG. 3A, designed to break or cut the core, which remains between the two rotating cylinders. The high-pressure water jets 185 can be mounted in several positions on this core breaker 190. This would also place the water jets 185 close to the surface being cut mechanically by the bits 105. In this and other mounting applications, either fixed- or swivel-mounted (not shown) water-jets can be used.

Figure 8:
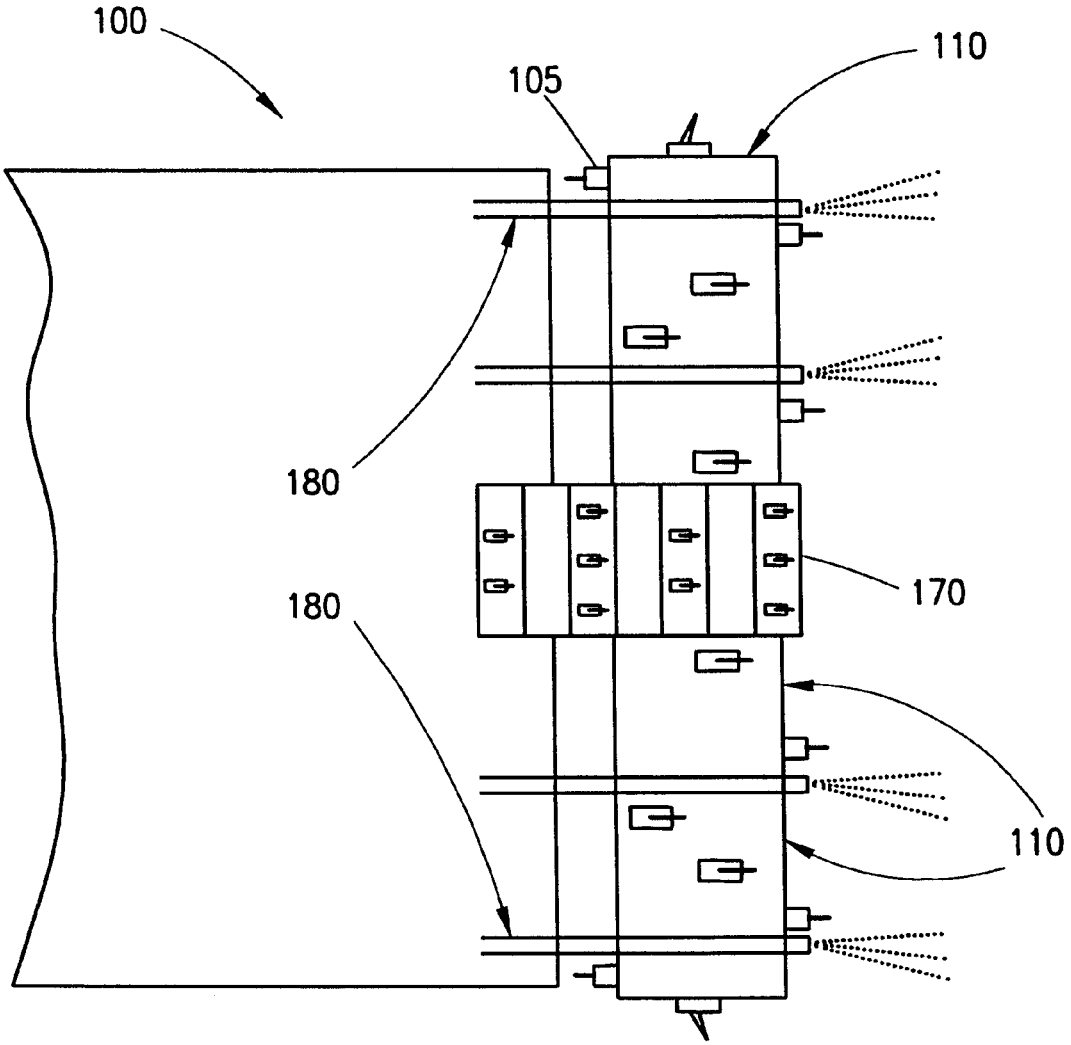
FIG. 8 is a top plan view of a ripper-chain embodiment of the water jet assisted cutting head of the present invention.

Turning now to FIG. 8, in conjunction with FIG. 3B, a ripper-chain embodiment miner of the present invention is illustrated. The drum 110 is segmented or formed of three sections which are linked together by a spline, axle or other means to turn as a single unit about a common axis of rotation. The central section has gear-like teeth 175, shown in FIG. 3B, which engage the underside of a ripper chain 170. The chain 170 is looped around the drum 110, and drive gears 160. As the drive gears 160 turn, the chain 170 and the drum 110 are rotated top-forward to mine coal.

As shown in FIG. 8, the chain 170 and the outer sections of the drum 110 have mechanical bits on their exterior surfaces. As shown in FIGS. 6A and 6B, rigid conduits 180 which are tapped to supply water nozzles 185 may be located above or below the cutting portions of the drum 110 or may be curved to fit completely around the drum 110. Although the depicted embodiment has four conduits or tubes 180 around the drum 110, it is understood that these rigid tubes 180 may be provided in any number which does not hinder the cutting drum 110. If necessary, mechanical bits 105 may even be removed from the drum 100 to provide the lateral spacing required for mounting the high pressure conduits or tubes 180.

The application of high-pressure water jets 185 to the drum-type continuous miner 100 allows additional hydraulic cutting power to be provided for the excavation of coal or other materials, beyond the power provided by the mechanical cutting head motors. This additional power is provided by high-pressure water pumps, not shown, which are powered by additional motors which may be located remotely from the continuous miner 100. Of course, if small enough, these high-pressure pumps, not shown, could also be located on the continuous miner itself.

The water jets 185 assist in the liberation of the coal from the working face. The high-pressure streams of water, which are produced by the water jets 185, actually penetrate and cut into the coal surface independent of and beyond the reach of the mechanical bits 105. These slots, or grooves, cut by the high-pressure water jets 185 reduce the amount of energy required for mechanical excavation by pre-fracturing the coal and providing additional free faces for the coal to break as it is impacted by the mechanical bits 105.

The high-pressure water jets 185 and the water provided to the working area also have the significant benefit of greatly reducing the amount of coal dust liberated during the mining process. The amount and pressure of water provided to each of the water nozzles 185 may further be varied independently, depending on the specific application.

By way of example only, Table 1 is provided to better illustrate how the use water jet assisted cutting on a drum-type miner may result in significant improvements in both penetration rate and production. For comparison purposes, a conventional drum-type miner in a ripper-chain configuration was first tested using mechanical cutting alone. The miner was then fitted with a water jet system according to the present invention. The water jets were supplied at about 6,000 psi and about 150–170 gallons per minute. Data from repeated trials were then averaged to produce Table 1. It is notable that the production with water jet assistance was nearly double that of the conventional mechanical bit drum-type miner.

TABLE 1

| Technique | Penetration (ft/min) | Production (tons/hour) | Cutting Motor (amps) |
|---|---|---|---|
| Mechanical Bits Only | 1.00 | 227 | 125–130 |
| Mechanical + Water Jets | 1.83 | 415 | 100 |

Repeated tests were also made to determine the best configuration and orientation of water jets 185. It was found that the water jets 185 on a single metal conduit 180 should focus cutting to produce a vertical groove or slot rather than random erosion of the entire face.

Figure 9A:
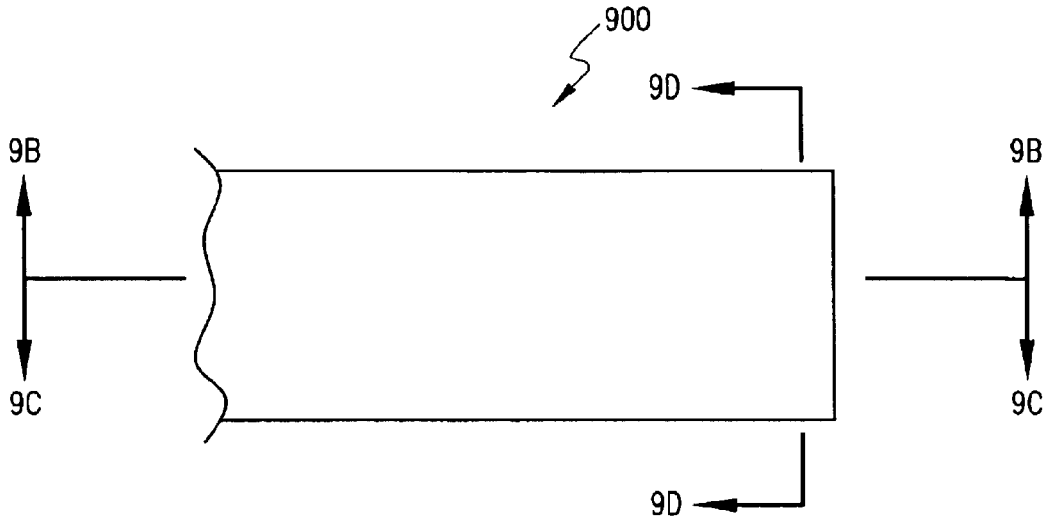
FIG. 9*a* is a fragmentary, top plan view of an exemplary strut having two exemplary water conduits therein.
Figure 9B:
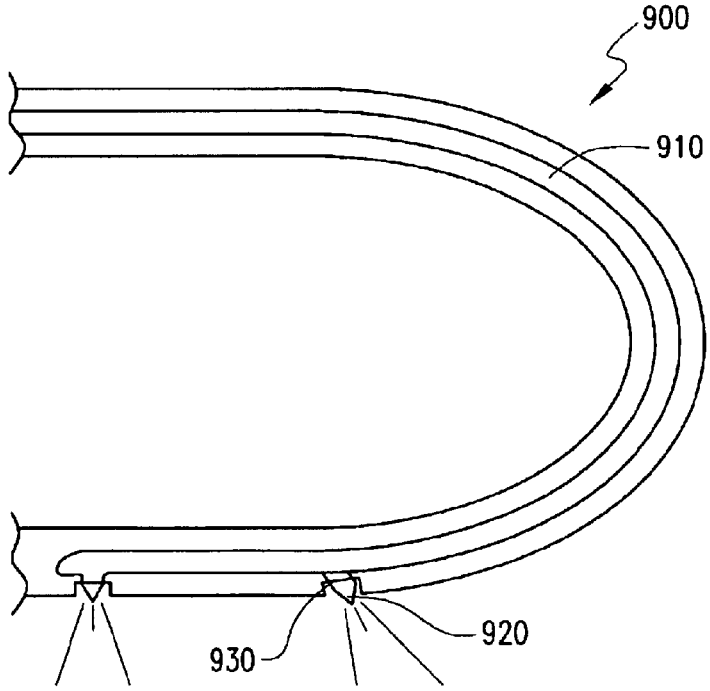
FIG. 9*b* is a side elevational cross-sectional view of a larger extent of the strut of FIG. 9*a* taken along line 9*b*—9*b* having an exemplary first water conduit therein.
Figure 9C:
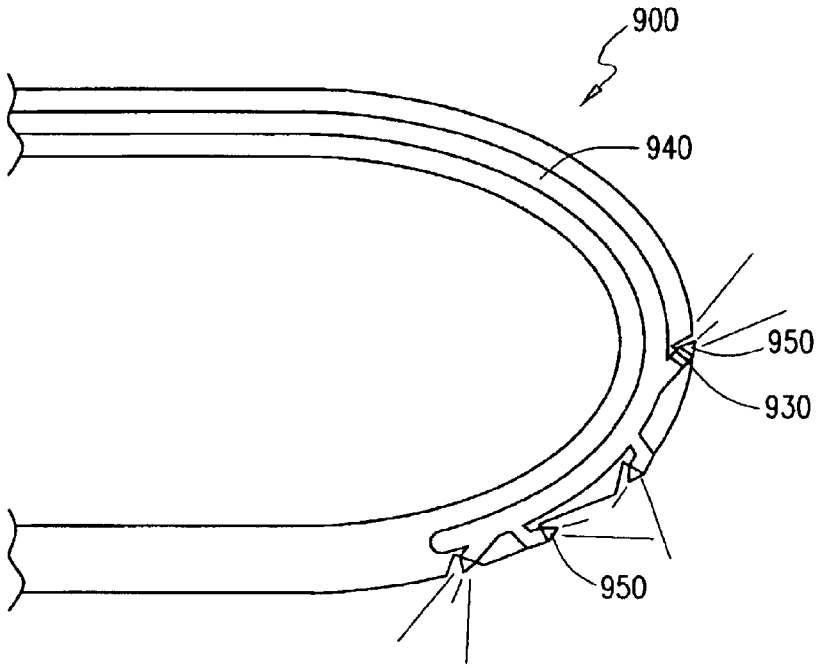
FIG. 9*c* is a side elevational cross-sectional view of a larger extent of the strut of FIG. 9*a* taken along line 9*c*—9*c* having an exemplary second water conduit therein.
Figure 9D:
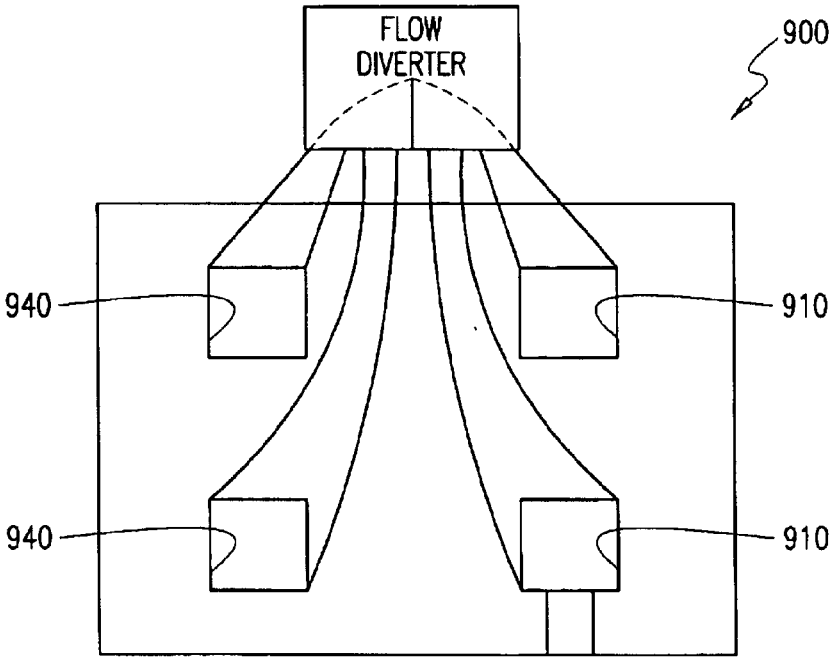
FIG. 9*d* is an enlarged, end elevational, partial cross-sectional view taken along line 9*d*—9*d* of FIG. 9*a;*

Referring now to FIG. 9A, there is shown a top plan view of an exemplary water jet assisted cutting head strut 900 of the present invention. FIGS. 9B–9D show the strut 900 in more detail. For example, FIG. 9B shows a side-elevational cross-sectional view of the water jet assisted cutting head strut 900 having a first high pressure fluid conduit 910 therein. The strut 900 may be shaped to fit between the exterior surface of the drum (not shown in this Figure) and the effective cutting diameter as defined by the mechanical bits. However, field testing has proved that the outer diameter of the strut 900 should be no closer than the outer edge of the mechanical bit block. If the strut 900 is closer than this, it will impede the cutting effectiveness of the mechanical bit.

As can be seen from FIG. 9B, the fluid conduit 910 fluidly connects to a plurality of nozzles 920 positioned at a predetermined angle with respect to the conduit 910. The nozzles 920 may secure to the conduit 910 via threads 930 and the like. The nozzles 920 are removable, and in certain embodiments the positioning of the nozzles 920 may be adjusted to change the angle of the nozzles 920 relative to the strut 900 depending on the mineral deposit height and hardness.

Referring now to FIG. 9C, there is shown a side-elevational cross-sectional view of the strut 900 having a second internal fluid conduit 940 therein. The second fluid conduit 940 similarly fluidly connects with a plurality of nozzles 950, which are alternately configured in either a first direction or a second direction. The number and directions of the nozzle configuration may be dependent on the height and hardness of mineral deposit to be cut and the approach of cutting, sumping, and shearing with the drum cutting head. The first fluid conduit 910 does not fluidly communicate with the second fluid conduit 940, such that the nozzles 920 of the first fluid conduit 910 may allow fluid therethrough independently of the nozzles 950 of the second fluid conduit 940. The nozzles 950 of the second fluid conduit 940 may be offset to avoid the first fluid conduit 910 in certain embodiments.

Referring now to FIG. 9D, there is shown a side-elevational partial cross-sectional end view of the strut 900 of FIGS. 9A–9C. Conduits 910, 940 are shown traversing through the strut 900.

Figure 10:
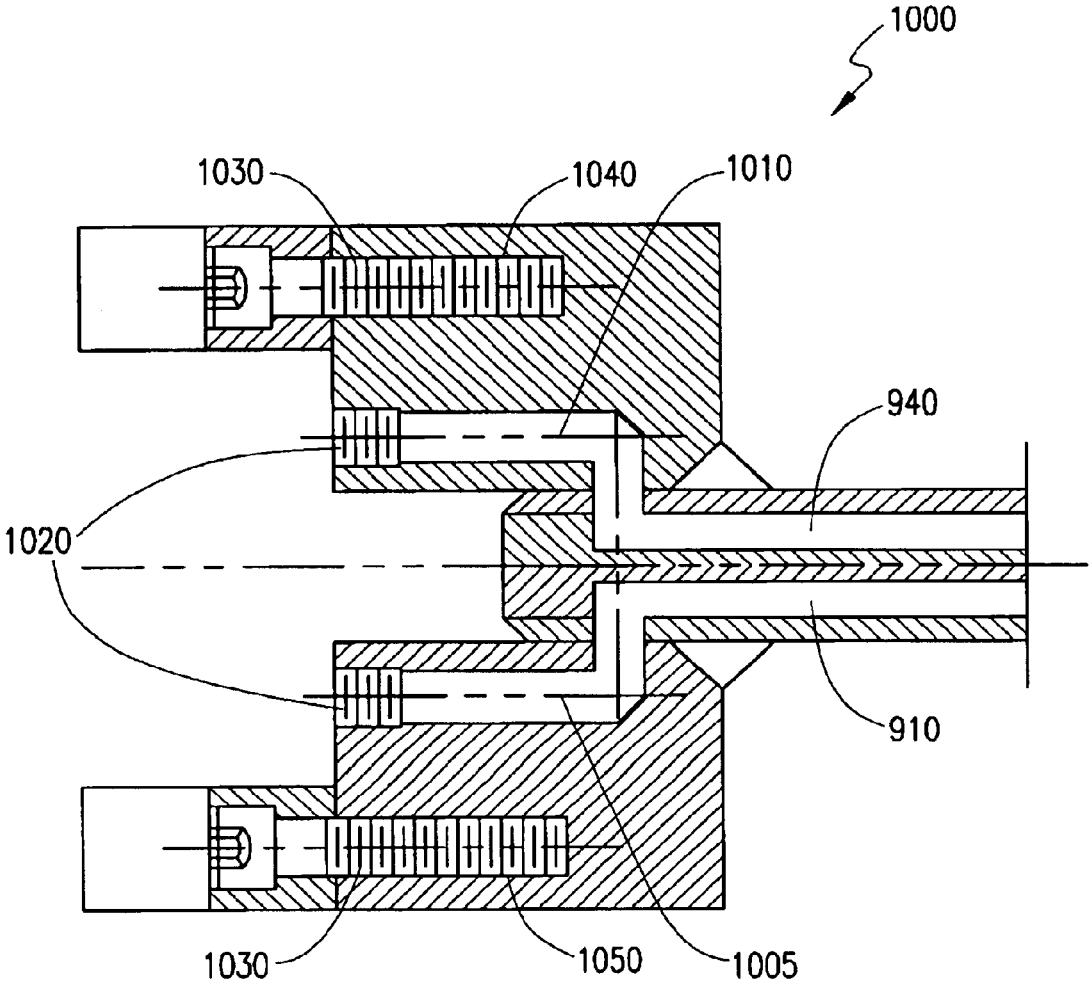
FIG. 10 is an enlarged, side elevational cross-sectional view of exemplary water inlets for the first and second water conduits of FIGS. 9*b* and 9*c;*

Referring now to FIG. 10, there is shown inlet connector 1000 in a side-elevational cross-sectional view. Inlet connector 1000 has respective inlets 1005, 1010 for the first fluid conduit 910 and the second fluid conduit 940 respectively. As can be seen in FIG. 10, the first fluid conduit 910 and the second fluid conduit 940 are separated from one another and are not fluidly connected. Threads 1020 may be provided at inlets 1005, 1010 for connection to a fluid source (not shown). Likewise, threads 1030 may be provided at a top portion 1040 and a bottom portion 1050 of the inlet connector 1000 for mechanically connecting the inlet connector 1000 to an external structure.

Figure 11A:
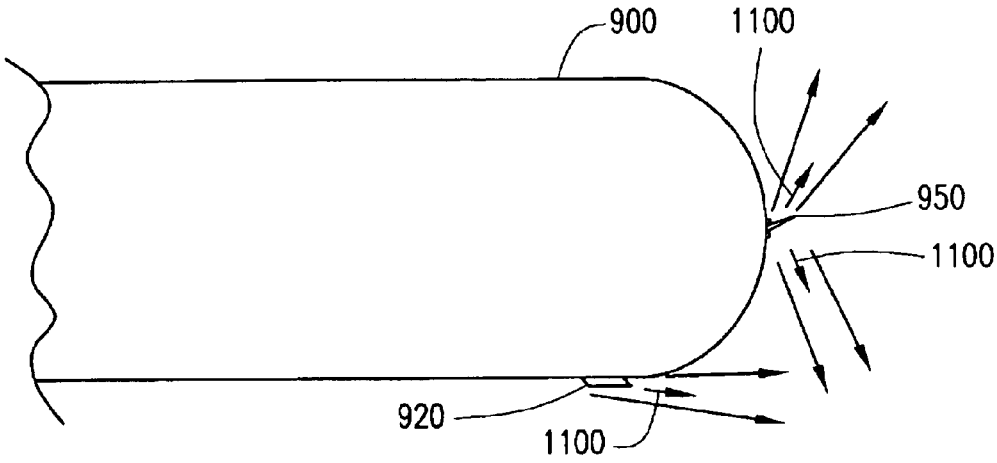
FIGS. 11*a*–11*b* are side elevational views of the strut perimeter of FIGS. 9*b* and 9*c* with selected nozzles allowing high-pressure fluid therethrough.
Figure 11B:
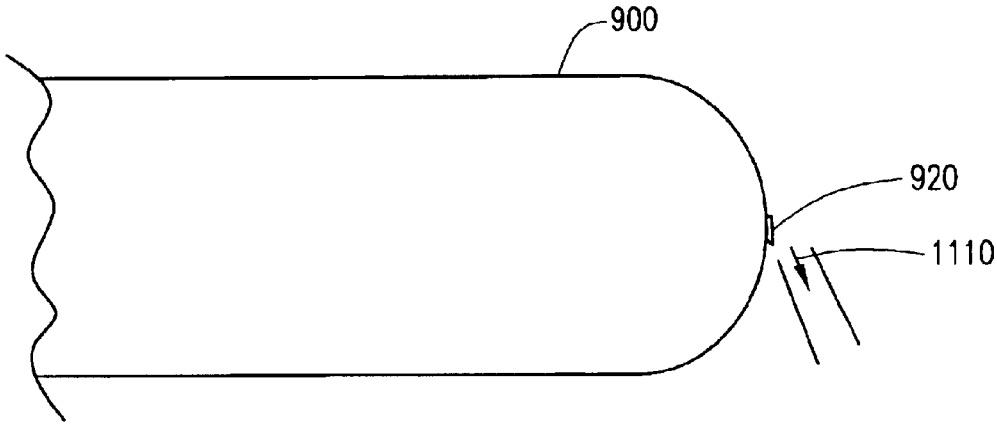

Referring now to FIGS. 11A and 11B, there is shown side profile views of the strut 900 of FIGS. 9B and 9C. Different water-jet spray configurations are shown. For example, FIG. 11*a* shows a first spray configuration wherein all nozzles 920, 950 are allowing high-pressure fluid therethrough in the direction indicated by arrows 1100, which may be referred to as sump mode. FIG. 11B shows a second spray configuration, referred to as shear mode, wherein high pressure fluid flows through the nozzles 920 in the direction indicated by arrows 1110. It is to be understood that the angles of the nozzles 920, 950 may be adjusted, such as through the use of different nozzles, different coupling means, or through different positioning of the nozzles 920, 950. It is also to be understood that the fluid flow through the conduits may be controlled such that flow may be directed at certain angles with respect to the strut 900 and through desired nozzles only.

Figure 12:
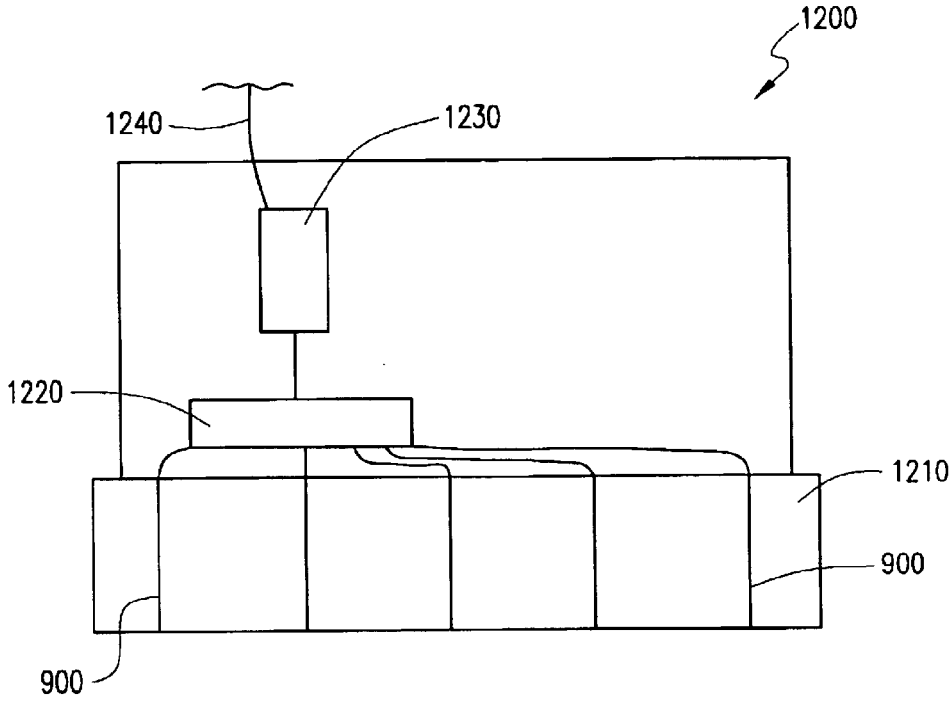
FIG. 12 is a schematic view of an exemplary flow system for the strut of FIG. 9*a*.

Referring now to FIG. 12, there is shown a schematic of a flow system 1200 for water jet assisted cutting head struts 900. The struts 900 are transversely mounted to the drum 1210. The struts 900 are fluidly connected to a manifold 1220 via fluid lines 1240 or the like. The manifold 1220 may contain the inlet connector 1000 (FIG. 10) for the respective strut 900, or the inlet connector 1000 may be placed in a region near the drum 1210 or other suitable locations. A flow divider 1230 is provided to divide flow from a high pressure fluid source (not shown) through the manifold 1220 and into a respective fluid conduit 940 of a respective strut 900. The manifold 1220 may be adapted to control fluid flow therethrough and into a respective strut 900.

The operation of strut 900 having dual fluid conduits can be described as follows: first, a preselected seam of mineral deposits is identified, and the cutting head having at least one strut 900 thereon is advanced toward the seam. High pressure fluid is passed through one or more conduits in the strut 900 and flows outwardly therefrom. The mechanical bits are actuated and engage the seam after the high pressure fluid has contacted the seam, which is referred herein as sumping. The cutting head is allowed to penetrate into the seam at least the distance about equal to ½ of the diameter of the cutting head. Next, the cutting head is moved downwardly with respect to the seam while the high pressure fluid is adjusted to flow in shear-mode, wherein fluid flows only through one of the two conduits in the strut 900. After reaching the base of the seam, fluid flow is terminated and the miner backs up to allow cleaning of the floor, then advances back to the coal face. The cycle may then be repeated.

The use of the dual channel water jet assisted cutting head provides significant advantages over cutting heads of prior systems. By way of example only, Table 2 is provided to better illustrate how the use of the dual channel jet assisted cutting on a drum-type miner may result in significant improvements in both penetration rate and production. For comparison purposes, conventional drum-type miner in a ripper-chain configuration was first tested using mechanical cutting alone. The miner was then fitted with a dual channel water jet system according to the present invention. The water jets were supplied at about 6,000 PSI and about 50–150 gallons per minute.

TABLE 2

| Technique | Flow (gpm) | Penetration Rate (ft/min) | Production (tons/hour) |
|---|---|---|---|
| Mechanical-no water assist-six cutting bits removed | — | 2.67 | 560 |
| Mechanical bits only-six cutting bits added from prior configuration | — | 2.77 | 581 |
| Dual channel water jet assist-two 0.043" nozzles on top and two 0.043" nozzles on bottom | 48 | 3.30 | 693 |
| Dual channel water jet assist-two 0.055" nozzles on top and two 0.055" nozzles on bottom | 78 | 3.67 | 769 |
| Dual channel water jet assist with four 0.055" nozzles on top and one 0.109" nozzle bottom | 150 | 4.00 | 840 |

As can be seen from Table 2, significant improvement is realized when nozzles from both conduits are actuated in phased-configurations (e.g. nozzles from both conduits are actuated simultaneously; only nozzles from one conduit are actuated). The size of the nozzles controls water flow and is likewise shown to affect production.

It is thus believed that the operation and construction of the present invention will be apparent from the foregoing description of a preferred embodiment. While the device shown is described as being preferred, it will be apparent to a person of ordinary skill in the art that various changes and modifications may be made therein without departing from the spirit and scope of the invention, as defined in the following claims. Therefore, the spirit and scope of the appended claims should not be limited to the description of the preferred embodiments contained herein.

What is claimed is:

1. A water jet assisted drum-type miner for mining coal or other mineral deposits comprising:

a transversely mounted drum having a plurality of mechanical cutting bits mounted on an exterior surface of said drum;

at least one motor providing mechanical power to rotate said drum in a top-forward manner to cut said mineral deposits;

first and second plurality of nozzles each being independently directed for emitting high pressure jets of fluid to cut said deposits independently of said mechanical cutting bits;

at least one strut transversely mounted on said drum and having said first and second plurality of nozzles thereon;

a first and second conduit positioned inside said at least one strut, said first conduit being adapted to supply a high pressure fluid to the first plurality of nozzles and the second conduit being adapted to supply a high pressure fluid to said second plurality of nozzles, said first and second conduit being adapted to receive said high pressure fluid through a first conduit inlet and a second conduit inlet, respectively;

wherein said first fluid conduit and said second fluid conduit maintain independent fluid flowpaths therein, and wherein said first and second conduit are externally mounted tubes located above or below the drum.

2. The miner of claim 1, wherein said first and said second conduit are adapted to allow fluid through said first plurality of nozzles and through said second plurality of nozzles simultaneously.

3. The miner of claim 1, wherein the number of said first plurality of nozzles is dependent on a hardness of said deposits.

4. The miner of claim 1, wherein the number of said second plurality of nozzles is dependent on a hardness of said deposits.

5. The miner of claim 1, wherein the angle of said first plurality of nozzles with respect to said deposits is adjustable.

6. The miner of claim 1, wherein the angle of said second plurality of nozzles with respect to said deposits is adjustable.

7. The miner of claim 1, wherein at least one of said first plurality of nozzles is angled downwardly with respect to said deposits.

8. The miner of claim 1, wherein at least one of said second plurality of nozzles is directed upwardly and at least one of said second plurality of nozzles is angled downwardly with respect to said deposits.

9. The miner of claim 1, further comprising a flow diverter fluidly connected to said strut for allowing fluid through said first conduit and first plurality of nozzles while preventing fluid from flowing through said second conduit and said second plurality of nozzles.

10. The miner of claim 1, further comprising a flow diverter fluidly connected to said strut for allowing fluid through said second plurality of nozzles while fluid is prevented from flowing through said first conduit and said first plurality of nozzles.

11. The miner of claim 1, wherein said strut is shaped to fit between the exterior surface of said drum and an effective cutting diameter as defined by said mechanical cutting bits, and positions said first plurality of nozzles and said second plurality of nozzles between said exterior surface of said drum and said mineral deposits which are being cut.

12. The miner of claim 1, wherein said nozzles are positioned between the exterior surface of said drum and an effective cutting diameter as defined by said mechanical cutting bits.

13. The miner of claim 1, wherein at least one of the nozzles are aligned to cut a vertical slot or groove.

14. A water jet assisted drum-type miner for mining coal or other mineral deposits comprising:

a transversely mounted segmented drum having a center portion with a plurality of gear-like teeth on an exterior surface and two cutting portions each having a plurality of mechanical cutting bits on an exterior surface;

a drive gear;

a ripper chain having a plurality of mechanical cutting bits mounted on an exterior surface, said ripper chain fitted about said drive gear and said center portion of said segmented drum;

at least one electrical motor providing mechanical power to rotate said drive gear, said ripper chain, and said segmented drum in a top-forward manner to cut said mineral deposits;

a plurality of nozzles positioned about said drum;

at least one strut transversely mounted to said drum;

a first conduit and a second conduit positioned in said at least one strut for supplying a high pressure fluid to said plurality of nozzles; and said plurality of nozzles each directing a high pressure jet of fluid in multiple directions to cut said deposits independently of said mechanical cutting bits.

15. The miner of claim 14, wherein said strut is shaped to fit between the exterior surface of said cutting portions of said segmented drum and an effective cutting diameter as defined by said mechanical cutting bits, and positions said nozzles between said exterior surface of said segmented drum and said mineral deposits which are being cut.

16. The miner of claim 15, wherein said nozzles are positioned between the exterior surface of said segmented drum and an effective cutting diameter as defined by said mechanical cutting bits.

17. The miner of claim 14, wherein said nozzles are aligned to cut a vertical slot or groove.

* * * * *